US010245481B1

(12) United States Patent
Cleghorn et al.

(10) Patent No.: US 10,245,481 B1
(45) Date of Patent: Apr. 2, 2019

(54) GOLF CLUB HEAD

(71) Applicant: Acushnet Company, Fairhaven, MA (US)

(72) Inventors: Richard L. Cleghorn, Oceanside, CA (US); Nick Frame, Vista, CA (US)

(73) Assignee: Acushnet Compnay, Fairhaven, MA (US)

( * ) Notice: Subject to any disclaimer, the term of this patent is extended or adjusted under 35 U.S.C. 154(b) by 0 days.

(21) Appl. No.: 15/850,836

(22) Filed: Dec. 21, 2017

(51) Int. Cl.
*A63B 53/04* (2015.01)

(52) U.S. Cl.
CPC .. *A63B 53/0466* (2013.01); *A63B 2053/0437* (2013.01)

(58) Field of Classification Search
USPC ..... 473/324–350
See application file for complete search history.

(56) References Cited

U.S. PATENT DOCUMENTS 5,092,599 A 3/1992 Okumoto
5,171,621 A * 12/1992 Desbiolles ..... A63B 53/04 428/141
D345,403 S * 3/1994 Sanchez ..... D21/752
D371,407 S * 7/1996 Ritchie ..... D21/733
5,700,208 A * 12/1997 Nelms ..... A63B 53/04 473/324
5,921,872 A * 7/1999 Kobayashi ..... A63B 53/04 473/345
6,001,029 A * 12/1999 Kobayashi ..... A63B 53/04 473/327
6,332,848 B1 * 12/2001 Long ..... A63B 53/04 473/328
6,776,725 B1 * 8/2004 Miura ..... A63B 53/0466 473/327
8,556,742 B2 * 10/2013 John ..... A63B 53/0466 473/219
8,608,587 B2 * 12/2013 Henrikson ..... A63B 53/0466 473/324
8,678,946 B2 * 3/2014 Boyd ..... A63B 53/02 473/327
8,790,196 B2 * 7/2014 Solheim ..... A63B 53/0466 473/344
8,986,132 B2 * 3/2015 Chen ..... A63B 53/0466 473/327

(Continued)

FOREIGN PATENT DOCUMENTS

JP 06007484 A * 1/1994 ..... A63B 53/0466
JP 10234892 A * 9/1998 ..... A63B 53/0466

(Continued)

*Primary Examiner* — Alvin Hunter
(74) *Attorney, Agent, or Firm* — Kristin D. Wheeler

(57) ABSTRACT

A golf club head where at least a first portion of an exterior surface of the golf club head includes depressions is disclosed herein. More specifically, the golf club head has a body with a striking face, a crown portion, a sole portion, and a skirt portion joining the striking face, crown portion and the sole portion and in accordance with the present invention at least a portion of the exterior surface of the body of the golf club head is further comprised of depressions to reduce the aerodynamic drag force on the golf club head. The depressions may be provided on a first portion of the golf club head on one or more of a crown portion, sole portion, skirt portion or striking face.

18 Claims, 19 Drawing Sheets

(56) References Cited

U.S. PATENT DOCUMENTS

| | | | | |
|---|---|---|---|---|
| 9,776,052 | B1 | 10/2017 | Solheim et al. | |
| 9,776,053 | B2 | 10/2017 | Burnett et al. | |
| 9,802,085 | B2 | 10/2017 | Stites et al. | |
| 2003/0220154 | A1 | 11/2003 | Anelli | |
| 2008/0188320 | A1* | 8/2008 | Kamatari ..... | A63B 53/0466<br>473/327 |
| 2017/0312591 | A1 | 11/2017 | Saso | |
| 2017/0319917 | A1 | 11/2017 | Henrikson | |

FOREIGN PATENT DOCUMENTS

| | | | | |
|---|---|---|---|---|
| JP | 2002272883 | A | * | 9/2002 |
| JP | 2009000281 | A | * | 1/2009 |

* cited by examiner

GOLF CLUB HEAD

FIELD OF THE INVENTION

The present invention relates generally to an improved golf club head wherein a portion of the exterior surface of the golf club head includes depressions. Using depressions on different portions of the exterior surface of the golf club head reduces the aerodynamic drag force on the golf club head allowing the club head to have improved club head speed during a swing.

BACKGROUND OF THE INVENTION

As shown in FIG. 1, a prior art club head 10 has a striking face 12, a crown surface 14 and a sole surface 16. During a golf swing, the club head 10 is in an air flow stream 18. As is understood in aerodynamics, when air flows over a surface, such as a club head 10, forces near the surface 14 of the club head 10 create a velocity gradient from the surface 14, where air flow velocity may be relatively slow, to the free stream region 20, where air velocity is not influenced by the club head. This velocity gradient region is called the boundary layer. Flow separation occurs when the boundary layer travels on the golf club head 10 far enough against an adverse pressure gradient that the air flow velocity in the boundary layer relative to the surface of the club head almost falls to zero. The air flow becomes detached from the surface of the club head and takes the form of eddies and vorticies 22. Flow separation may result in increased drag which may be caused by the pressure differential between the front and rear surfaces of the club head. The increased drag may reduce the speed of the club head, which in turn may lower the velocity of a golf ball that is struck by the club head.

Generally golf club heads have had smooth exterior surfaces, with only grooves, i.e. scorelines, on the striking face of the club head. A smooth surface, however, may result in greater drag force on the club head, or increased separation of the air flow from the club head, and an associated reduction in club head speed.

U.S. Pat. No. 5,092,559 to Okumoto et al. illustrates a wood golf club head with steps extending transversely on an upper surface of the club head or a large dimple extending over the rear portion of the upper surface of the club head.

U.S. Pat. No. 6,001,029 to Kobayashi illustrates a club head with decreased air resistance having depressions formed on a back of a crown and side surfaces of a heel and toe of a club head. Each depression has a first side narrower than a second side thereof so that it is egg shaped. Gentle slopes are provided at the first side of each depression so that the generation of dead air region is suppressed at the inflow side of each depression and further decreases the air resistance in swinging.

U.S. Pat. No. 9,776,052 to Solheim et al. illustrates golf club head having a recess in the crown portion and a plurality of apertures is defined in the recess and a protective cover is configured to engage the crown to cover the plurality of the crown apertures.

U.S. Pat. No. 9,776,053 to Burnett et al. illustrates a golf club incorporating a trip step feature on the crown section. A portion of the trip step is located between a crown apex and the back of the club head and may be continuous or discontinuous.

U.S. Publ. No. 2017/0312591 to Saso illustrates a club head configured to decrease air resistance by avoiding the air flows from retouching the head surface. The club head is provided with a ridge structure which contains a first ridge and second ridge arranged at intervals in a downward direction of the air flows on at least the sole of a club head.

U.S. Publ. No. 2017/0319917 to Henrikson et al. illustrates a golf club with turbulators, including a plurality of ridges disposed on the crown of the club head and a method of manufacturing golf club heads with turbulators.

Thus, it is desirable to reduce the separation of the air flow from the club head so that associated drag on the club head is reduced thereby improving club head speed.

BRIEF SUMMARY OF THE INVENTION

In one aspect of the present invention a golf club head is provided comprising a body having a face, a sole portion, a crown portion and a skirt portion joining the face, sole portion and crown portion, a hollow golf club interior within the body, an exterior surface provided opposite the hollow golf club interior, and a plurality of depressions provided on a first portion of the exterior surface of the body. The plurality of depressions have a depth of about 0.5 mm to about 2 mm, have a width of about 6 mm to about 20 mm and have a minimum landing surface spacing of about 0.5 mm to about 7 mm between depressions on the exterior surface.

In another aspect of the invention, the first portion may be provided on at least one of a sole portion or crown portion of the body. The first portion may be provided on at least half of the crown portion. Alternatively, the first portion is provided on the entire crown portion. In another aspect of the invention, the first portion is provided on at least half the sole portion. Alternatively, the first portion may be provided on the entire sole portion. A setback may be provided from the face portion of the body, the setback being free of depressions. The setback may have a width of about 6 mm to about 14 mm. The first portion may have a depression coverage of about 25% to about 75%. In yet another aspect of the invention, the body has a toe portion on one side of the body adjacent the face and a heel portion on the opposite side of the body adjacent the face and hosel, and the first portion extends from the toe of the body to the heel of the body. The depressions may have a polygonal shape. The body may have a front adjacent the face of the body and a rear opposite the face of the body and the depressions decrease in size from the front toward the rear of the body. The golf club head may have a volume of about 420cc to about 475cc.

In yet another aspect of the present invention, a golf club head is provided comprising a body having a face, a sole portion, a crown portion and a skirt portion joining the face portion, sole portion and crown portion, a hollow golf club interior within the body; and an exterior surface provided opposite the hollow golf club interior. A first aerodynamic drag force reduction of the club head is achieved by shaping the body of the club head, and a second aerodynamic drag force reduction of the club head is achieved by providing a plurality of depressions on a first portion of the exterior surface of the body, and where the additional reduction in aerodynamic drag force achieved by the second aerodynamic drag force reduction is about 5 to about 25 percent.

In another aspect of the invention, the second reduction in aerodynamic drag force is about 10 to about 18 percent. The first portion may be provided on at least one of a sole portion or crown portion of the body. The first portion may be provided on at least half of the crown portion. Alternatively, the first portion is provided on the entire crown portion. The first portion may be provided on at least half the sole portion.

Alternatively, the first portion is provided on the entire sole portion. A setback may be provided from the face portion of the body, the setback being free of depressions. The setback may have a width of about 6 mm to about 14 mm. The first portion may have a depression coverage of about 25% to about 75% of the club head portion. The body may have a toe portion on one side of the body adjacent the face and a heel portion on the opposite side of the body adjacent the face and hosel and the first portion extends from the toe of the body to the heel of the body. Each of the plurality of depressions may have a depth of about 0.5 mm to about 2 mm and have a width of about 6 mm to about 20 mm. The depressions may have a landing surface spacing of about 1 mm to about 4 mm between depressions on the exterior surface. The depressions may have a polygonal shape. The body may have a front adjacent the face of the body and a rear opposite the face of the body and the depressions decrease in size from the front toward the rear of the body. The golf club head may have a volume of about 420cc to about 475cc. These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
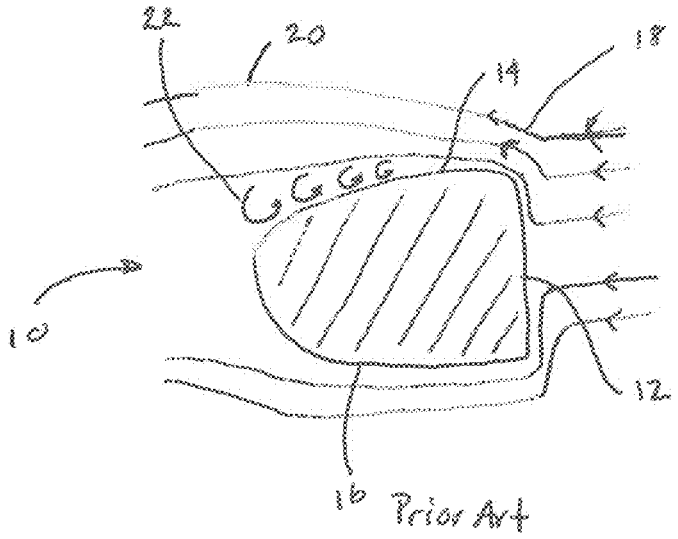
FIG. 1 of the accompanying drawings is a cross-sectional view of a prior art golf club head showing the air flow occurring with a conventional wood golf club head.
Figure 2:
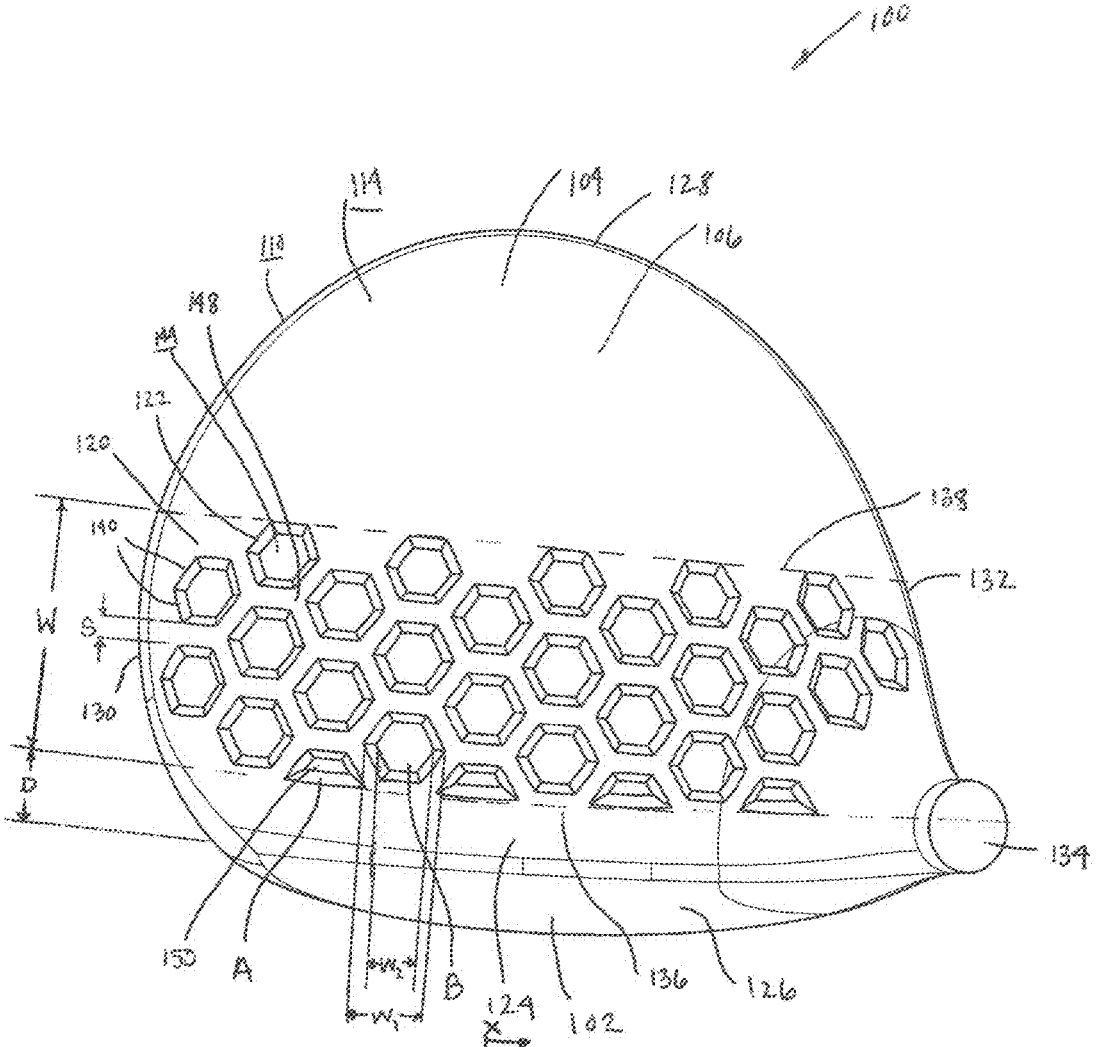
FIG. 2 of the accompanying drawings shows a top view of a club heading in accordance with a preferred exemplary embodiment of the present invention.
Figure 3:
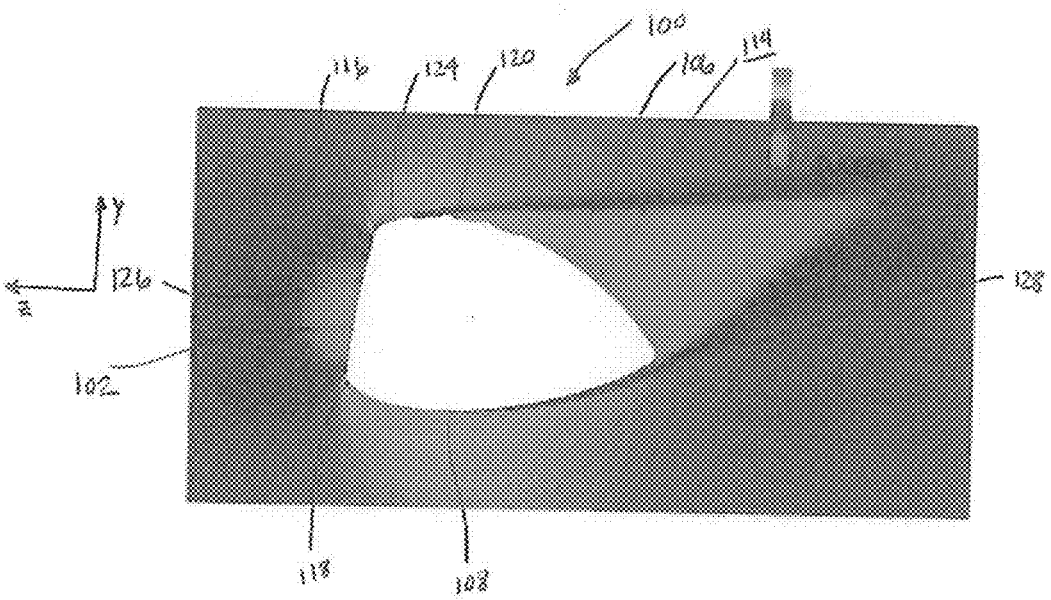
FIG. 3 of the accompanying drawings is a side view of the golf club head of FIG. 2 showing air flow occurring over the exemplary golf club head.

FIG. 2 shows a top view of a golf club head 100 in accordance with an exemplary embodiment of the present invention. Golf club head 100 shown in FIG. 2 may generally have a striking face 102 at a frontal portion of the golf club head 100 and a body portion 104 at an aft portion golf club head 100. The body portion 104 may generally be further comprised of a crown portion 106 near a top of the golf club head 100 and a sole portion 108 (FIG. 3) located near a bottom of the golf club head 100 and a skirt portion 110 joining the striking face 102, crown portion 106 and sole portion 108. The golf club head 100 has a hollow interior 112 (FIG. 4) and an exterior surface 114 provided opposite the hollow golf club interior 112. The striking face 102 has an upper leading edge 116 and a lower leading edge 118 (FIG. 3). According to the invention, at least a first portion 120 of the exterior surface 114 is provided with a plurality of indentations or depressions 122. It will be appreciated that the first portion 120 will have a depression coverage, comprising the percentage of the first portion 120 having the depressions 122 as measured on the exterior surface 114 as it extends over the first portion 120. Preferably, the first portion 120 will have a depression coverage of about 25% to about 75%, more preferably about 35% to about 65%. As shown in FIG. 2, the depression coverage is about 50%. Additionally, preferably the first portion 120 covers about 35% to about 65% of the club head 100 exterior surface 114.

The first portion 120 of the exterior surface 114 may include a portion of one or more of the crown portion 106, sole portion 108, skirt portion 110 or striking face 102. Preferably, as shown in FIG. 2, the first portion 120 is provided on either the crown portion 106 or the sole portion 108, although it will be appreciated that the first portion 120 may be provided on any other portion of the club head 100 as desired.

Figure 4:
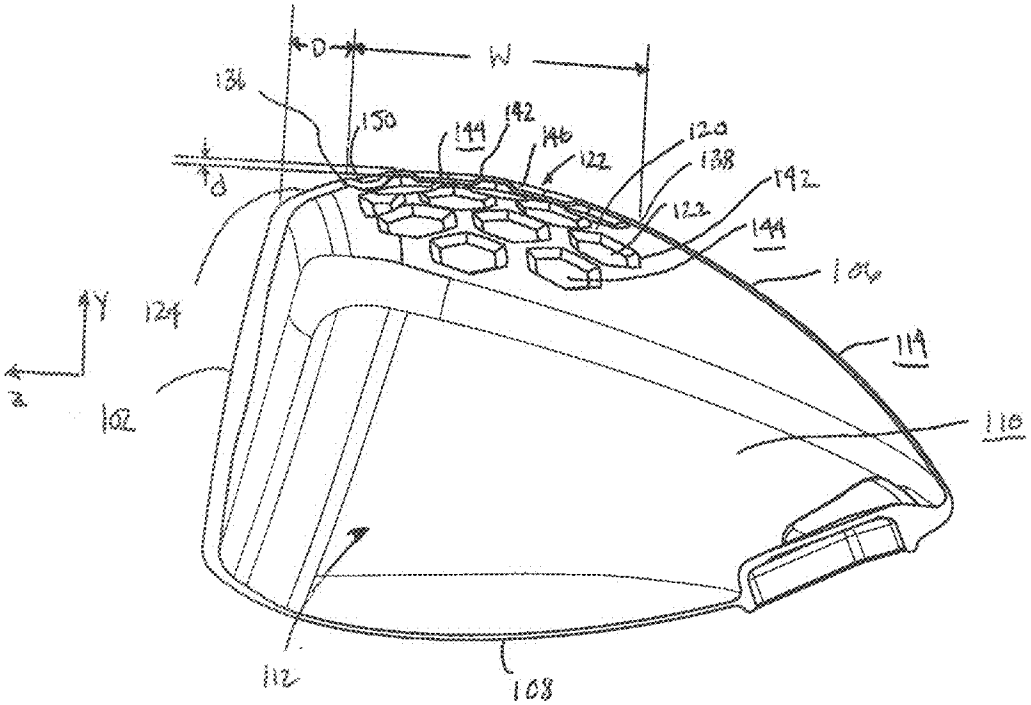
FIG. 4 of the accompanying drawings shows an enlarged cross-sectional view of a crown portion of the exemplary golf club head of FIG. 2.

As shown in FIGS. 2 and 4, the golf club head 100 further includes a setback 124 from the face 102 of the body portion 104 before the start of the first portion 120. The setback 124 is shown free of depressions 122. The setback 124 preferably has a distance D of from about 6 mm to about 14 mm from the face 102 of the club head 100, as shown about 10 mm, although it will be appreciated that any suitable distance may be used. As illustrated in FIG. 2, the body 104 has a front 126 adjacent the face 102 of the club head 100 and a rear 128 opposite the face 102 of the club head 100. The body portion 104 has a toe portion 130 on one side of the body portion 104 between the face 102 and rear 128 of the club head 100 and a heel portion 132 on the opposite side of the body 104 with a hosel 134 between the face 102 and rear 128 of the club head 100. Preferably, as shown, the first portion 120 extends from the toe portion 130 of the body to the heel portion 132. Moreover, as shown in the embodiment of FIG. 4 the first portion 120 has a width W between a first boundary 136 adjacent the face 102 and a second boundary 138 adjacent the rear 128 of the club head 100. As shown, the width W is about 40 mm. The depressions 122 shown in FIG. 2 have a polygonal shape. This particular embodiment uses hexagons having six equal sides 140. It will be appreciated that the depressions 122 may have any suitable shape, regular polygon or otherwise. It will be appreciated that any polygon may have sides 140 of equal length as shown, or unequal lengths.

FIG. 3 illustrates the drag on the club head 100 according to the embodiment of FIGS. 2 and 4. The present invention seeks to reduce the drag force on a club head 100. In a preferred embodiment, a first aerodynamic drag force reduction of the club head 100 is achieved by altering the conventional shape of the body portion 104 of the club head 100. This first aerodynamic drag force reduction would include making the crown portion 106 more bulbous in shape, raising the lower leading edge 118, dropping the upper leading edge 116 and altering the shape of the face 102 and size of the face 102 of the club head 100. A second aerodynamic drag force reduction according to the present invention of the club head 100 improves the aerodynamic drag force reduction from a well-shaped club head. The second aerodynamic drag force reduction is achieved by providing a plurality of indentations or depressions 122 on a first portion 120 of the exterior surface 114 of the body portion 104. This second aerodynamic reduction results in an aerodynamic drag force reduction of about 5 to about 25 percent better than using the first aerodynamic drag force reduction techniques alone. In a preferred embodiment, the second aerodynamic reduction results in an aerodynamic drag force reduction of about 10 to about 18 percent. To approximate drag force, a computational fluid dynamics (CFD) software may be utilized. Examples of such software include OpenFOAM, Fluent, and LS-DYNA. The exterior surface 114 of a club head 100 is used to define a stationary wall boundary in a virtual wind tunnel. The club head 100 is centrally positioned in the virtual wind tunnel and air velocity is set comparable to that of a club head 100 hitting a golf ball. A club head 100 based coordinate system (FIGS. 2 and 4) is defined such that the x-axis is parallel to the scorelines on the face 102, positive toward the heel portion 132; the y-axis is perpendicular to the x-axis, positive toward the crown portion 106; and the z-axis at geometric face-center is perpendicular to the face 102, x-axis, and y-axis, and positive out of the face 102. An air speed of about 100 mph was used during the simulation with the head coordinate system it was: zero in the x-direction, 100*sin (head loft) in the y-direction, and 100*cos (head loft) in the negative z-direction. The simulation was allowed to reach steady-state to determine the drag force. In this simulated testing, the large bodied traditional driver had an aerodynamic drag force of about 4.4N to start. The first aerodynamic drag force reduction techniques described above reduced the aerodynamic drag force to 3.45N. The second drag force reduction technique, as shown in FIG. 2, further reduced the aerodynamic drag force to 2.92N. Thus, the embodiment shown in FIGS. 2-4 resulted in a club head 100 having an additional second aerodynamic drag force reduction of about 15%. This additional reduction of aerodynamic drag force will improve club head speed and result improved ball speed off of the face 102 of the club head 100 and improve carry distance and overall performance of shots hit off of the club head 100.

FIG. 4 illustrates a portion of a cross-sectional view of the embodiment of FIG. 2. As is illustrated, the depressions 122 have a depression edge 142 where the depression 122 mates with the exterior surface 114 of the club head 100, a base 144 of the depression 122, and depression side walls 146. Surface landing 148 is provided between the depressions 122 and has a spacing s that is preferably measured at the two closest points between two adjacent depressions 122. As is shown, depressions 122 have a largest depth d, a top width $w_1$ (FIG. 2) at a top of the depression 122 at the exterior surface 114 of the club head 100, a base width $w_2$ (FIG. 2) at the base 144 of the depression 122. The top width $w_1$ and base width $w_2$ are typically measured from the front 126 to rear 128 directions of the club head 100, although it will be understood that generally it is taken at the largest measurement for the depression 122. It will be appreciated that the depressions 122 shown in FIG. 4 have a base width $w_2$ that is narrower than the top width $w_1$, although it will be appreciated that this may not always be the case. For example, the side wall 146 may be perpendicular to the base 144 and as such the base width $w_2$ and top width $w_1$ may be substantially equivalent. Preferably, the depressions 122 have a top width $w_1$ and a base width $w_2$ of about 6 mm to about 20 mm, more preferably about 9 mm to 18 mm, a depth d of about 0.5 mm to about 2 mm, and surface landing 148 has a surface landing spacing s between depressions 122 of about 0.5 mm to about 7 mm. In this embodiment, the top width $w_1$ is about 13 mm, the base width $w_2$ is about 10 mm, the depth d is about 1 mm, and the landing spacing s is about 2.5 mm. The base 144 of the depression 122 as shown is flat, although it will be appreciated that the base 144 may be curved. In this case the depression depth d would be the largest depth d in the depression 122. The setback 124 preferably has a distance D of about 6 mm to about 14 mm from the face 102 to the first boundary 136 of the first portion 120. As discussed previously, distance D in the embodiment of FIGS. 2 and 4 is about 10 mm. As noted previously, the setback 124 is free of depressions 122. As shown in FIGS. 2 and 4, the depressions 122 are provided in rows A, B such that depressions 122 are offset from one another from the front 126 of the club head 100 to the rear 128 of the club head 100. Thus, the depressions 122 in first row A provided adjacent the first boundary 136 of the first portion 120 are provided as partial depressions 150. This embodiment does not have partial depressions adjacent the second boundary; however, it will be appreciated that partial depressions 150 may be provided in this location. The depressions 122 in this embodiment are shown to have the same shape, top width $w_1$ and base width $w_2$ and depth d, such that each depression 122 on the first portion 120 is the same. However, it will be appreciated that the depressions 122 provided may have different sizes, shapes and/or depths. It will also be appreciated that additional partial depressions 150 may be provided adjacent the hosel 134, heel 132 and toe 130 as needed. Moreover, the depressions 122 provided toward the face 102 or front 126 of the club head 100 may be slightly larger than the depressions 122 provided toward the rear 128 of the club head 100. This difference in width $w_1$, $w_2$ may preferably be about 0.5-4 mm and depression depth d may preferably be about 0.1 to 1.5 mm, although any suitable difference in depression 122 size, shape and/or depth may be used.

Figure 5:
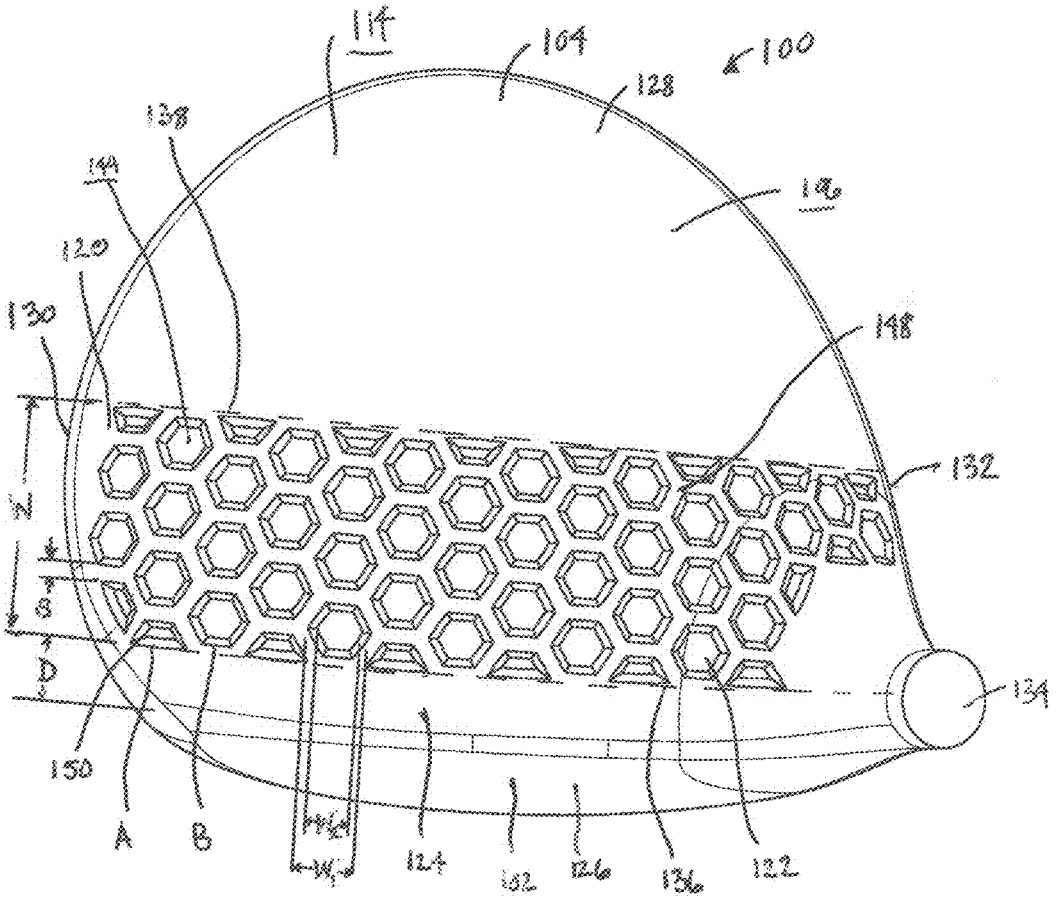
FIG. 5 of the accompanying drawings shows a top view of a club head in accordance with an alternative exemplary embodiment of the present invention.

Referring now to the embodiment of FIG. 5, a golf club head 100 is shown in accordance with another exemplary embodiment of the present invention. Golf club head 100 as described previously and shown in FIG. 5 has an exterior surface 114 provided opposite the hollow golf club interior. According to the invention, at least a first portion 120 of the exterior surface 114 is provided with a plurality of indentations or depressions 120. The first portion 120 of the exterior surface 114 is shown to be provided on the crown portion 106. A setback 124 is provided in this embodiment, spacing the first portion 120 a distance D from the face 102 of the club head 100. As shown, distance D is about 10 mm. The first portion 120 as shown has a depression coverage of about 50%. As discussed previously with regard to FIG. 2, the depressions 120 are provided from a toe 130 to a heel 132 of the club head 100 and the first portion 120 has a width W between first and second boundaries 136, 138. As shown, width W is about 40 mm. It will be appreciated that alternating rows A, B of depressions 122 are provided, such that the rows A, B are offset from one another by a half portion of the depression 122, or half of the width $w_1$, thereby providing partial depressions 150 at the start or end of the rows A, B adjacent the first or second boundary 136, 138 of the first portion 120. Additional partial depressions 150 are provided as needed on the first portion at the hosel 134, heel 132 and toe 130 of the club head 100. The exterior surface 114 provided between the spaced depressions 122 as shown has a minimum landing surface spacing s of about 2 mm. The depressions 122 provided in this embodiment are hexagons of a smaller size than those provided in the embodiment of FIG. 2. In this embodiment, the largest top width $w_1$ is about 9 mm. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1.0 mm. It will be appreciated that in this embodiment the hexagons provided on the first portion 120 are the same; however, it will be appreciated that the hexagons may vary in size, shape and/or depth. For example, they may decrease in size from the first boundary 136 to the second boundary 138 of the first portion 120.

Figure 6:
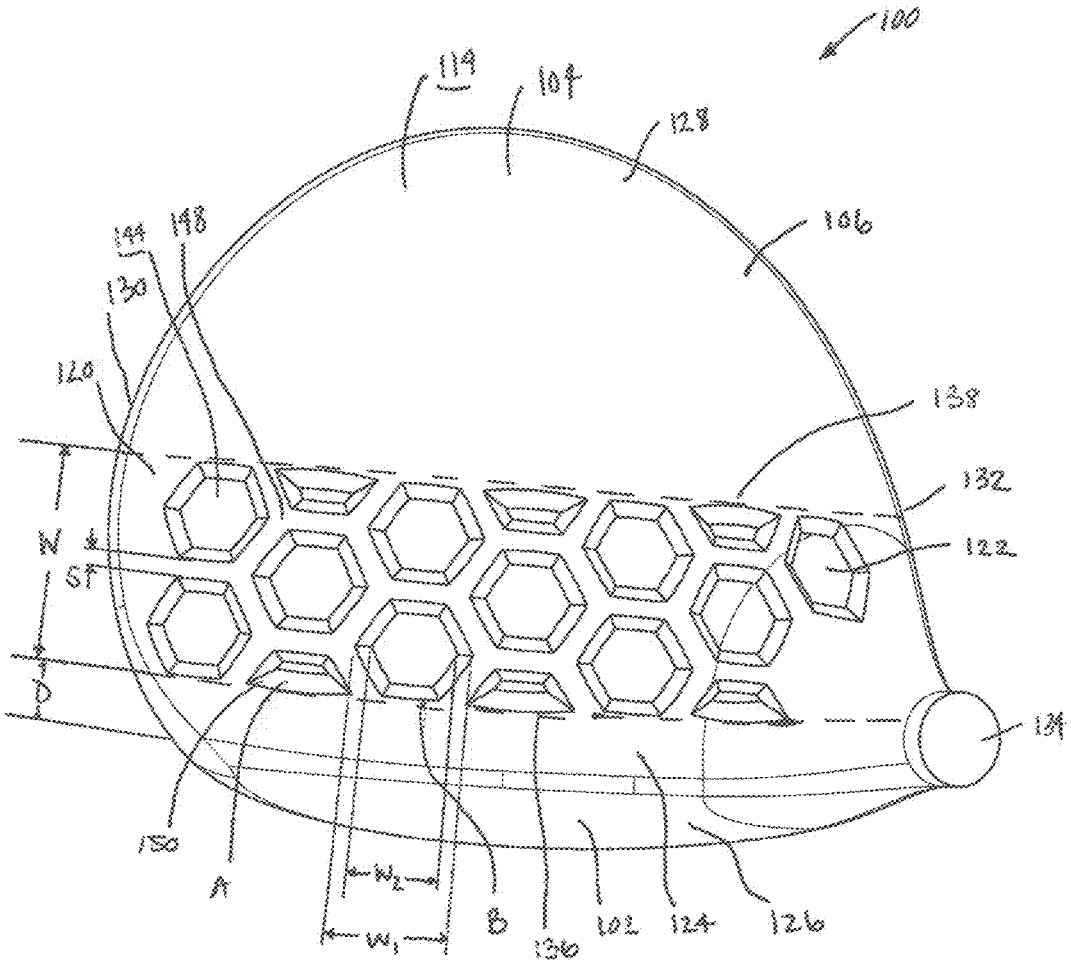
FIG. 6 of the accompanying drawings shows a top view of a club head in accordance with an alternative exemplary embodiment of the present invention.

As shown in FIG. 6, club head 100 in accordance with another exemplary embodiment of the present invention is provided. Club head 100 as described previously and shown in FIG. 6 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown to be provided on the crown portion 106. A setback 124 is provided in this embodiment, spacing the first portion 120 a distance D from the face 102 of the club head 100. As shown, the distance D is about 10 mm. The first portion 120 as shown has a depression coverage of about 50%. As discussed previously with regard to FIG. 2, the depressions 120 are provided from a toe 130 to a heel 132 of the club head 100 and the first portion 120 has a width W between first and second boundaries 136, 138. As shown, width W is about 40 mm. It will be appreciated that alternating rows A, B of depressions 122 are provided on the first portion 120 in a front 126 to a back 128 orientation on the club head 100, such that the rows A, B are offset from one another by about a half of the depression 122, or half of the width $w_1$, thereby providing partial depressions 150 at the start and end of row A adjacent the first and second boundary 136, 138. The landing surface 148 provided between the spaced depressions 122 as shown has a minimum landing surface spacing s of about 3.5 mm. The depressions 122 provided are hexagons of a larger size than those shown in the embodiment of FIG. 2, having a maximum width $w_1$ of about 18 mm. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1 mm. In this embodiment the hexagons provided on the first portion 120 are the same; however, it will be appreciated that they may vary in size, shape and/or depth.

Figure 7:
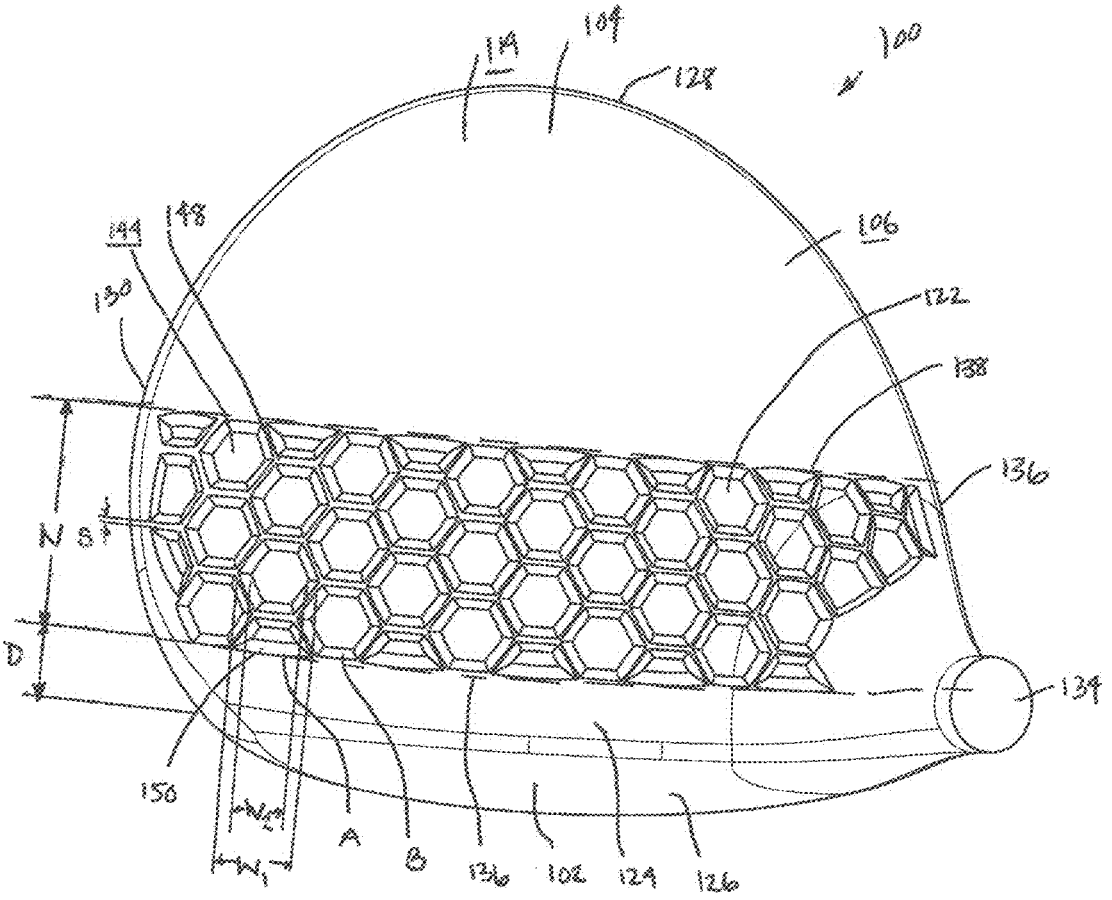
FIG. 7 of the accompanying drawings shows a top view of a club head in accordance with an alternative exemplary embodiment of the present invention.

Referring now to FIG. 7, a golf club head 100 in accordance with another exemplary embodiment of the present invention is shown. Golf club head 100 as described previously and shown in FIG. 7 has an exterior surface 114 provided opposite the hollow golf club interior. According to the invention, at least a first portion 120 of the exterior surface 114 is provided with a plurality of indentations or depressions 122. The first portion 122 of the exterior surface 114 is shown to be provided on the crown portion 106. A setback 124 is provided in this embodiment, spacing the first portion 120 a distance D from the face 102 of the club head 100. As shown, the distance D is about 10 mm. The first portion 120 as shown has a depression coverage that is increased to about 75% as compared to the embodiment of FIG. 2. As discussed previously with regard to FIG. 2, the depressions 122 are provided from the toe 130 to the heel 132 of the club head 100 and the first portion 120 has a width W between first and second boundaries 136, 138. As shown, the width W is about 40 mm. It will be appreciated that alternating rows A, B of depressions 122 are provided on the first portion 120 in a front 126 to rear 128 orientation on the club head 100, such that the rows A, B are offset from one another by about a half of the depression 122, or half of the width w1, thereby providing partial depressions 150 at the start and end of rows A adjacent the first and second boundary 136, 138. Moreover, additional partial depressions 150 are provided as needed on the first portion at the hosel 134, heel 132 and toe 130 of the club head 100. The landing surface 148 in this embodiment provided between the spaced depressions 122 has been minimized to increase depression coverage on the first portion 120. The landing surface 148 as shown has a minimum landing surface spacing s of about 0.5 mm. In this embodiment, the depressions 122 are hexagons having a maximum top width $w_1$ of about 13 mm. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1 mm. In this embodiment the hexagons provided on the first portion 120 are the same; however, it will be appreciated that the hexagons may vary in size, shape and/or depth.

Figure 8:
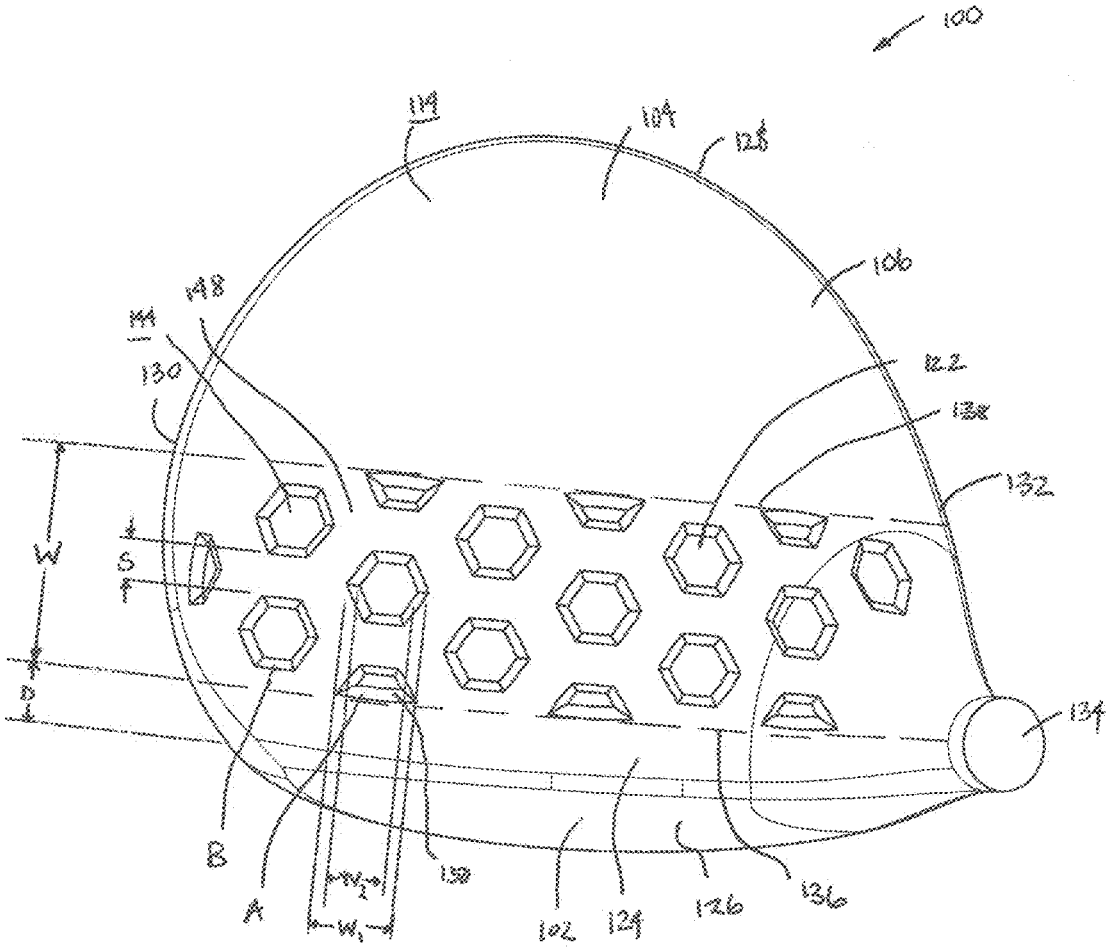
FIG. 8 of the accompanying drawings shows a top view of a club head in accordance with an alternative exemplary embodiment of the present invention.

As shown in FIG. 8, a golf club head 100 in accordance with another exemplary embodiment of the present invention is shown. Golf club head 100 as described previously and shown in FIG. 8 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown to be provided on the crown portion 106. A setback 124 is provided in this embodiment, spacing the first portion 120 a distance D from the face 102 of the club head 100. As shown, the distance D is about 10 mm. The first portion 120 as shown has a depression coverage that is decreased to about 25% as compared to the embodiment of FIG. 2. As discussed previously with regard to FIG. 2, the depressions 122 are provided from the toe 130 to the heel 132 of the club head 100 and the first portion 120 has a width W between first and second boundaries 136, 138. As shown, the width W is about 40 mm. It will be appreciated that alternating rows A, B of depressions 122 are provided on the first portion 120 in a front 126 to rear 128 orientation on the club head 100, such that the rows A, B are offset from one another by about a half of the depression 122, or half of the top width $w_1$, thereby providing partial depressions 150 at the start and end of row A adjacent the first and second boundary 136, 138. Moreover, additional partial depressions 150 are provided as needed on the first portion at the hosel 134, heel 132 and toe 130 of the club head 100. The landing surface 148 provided between the spaced depressions 122 has been increased to decrease depression coverage on the first portion 120. The landing surface 148 as shown has a minimum landing surface spacing s of about 7.0 mm. In this embodiment, the depressions 122 provided are hexagons having a maximum top width $w_1$ of about 13 mm. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1 mm. In this embodiment, the hexagons provided on the first portion 120 are the same; however, it will be appreciated that the hexagons may vary in size, shape and/or depth.

Figure 9:
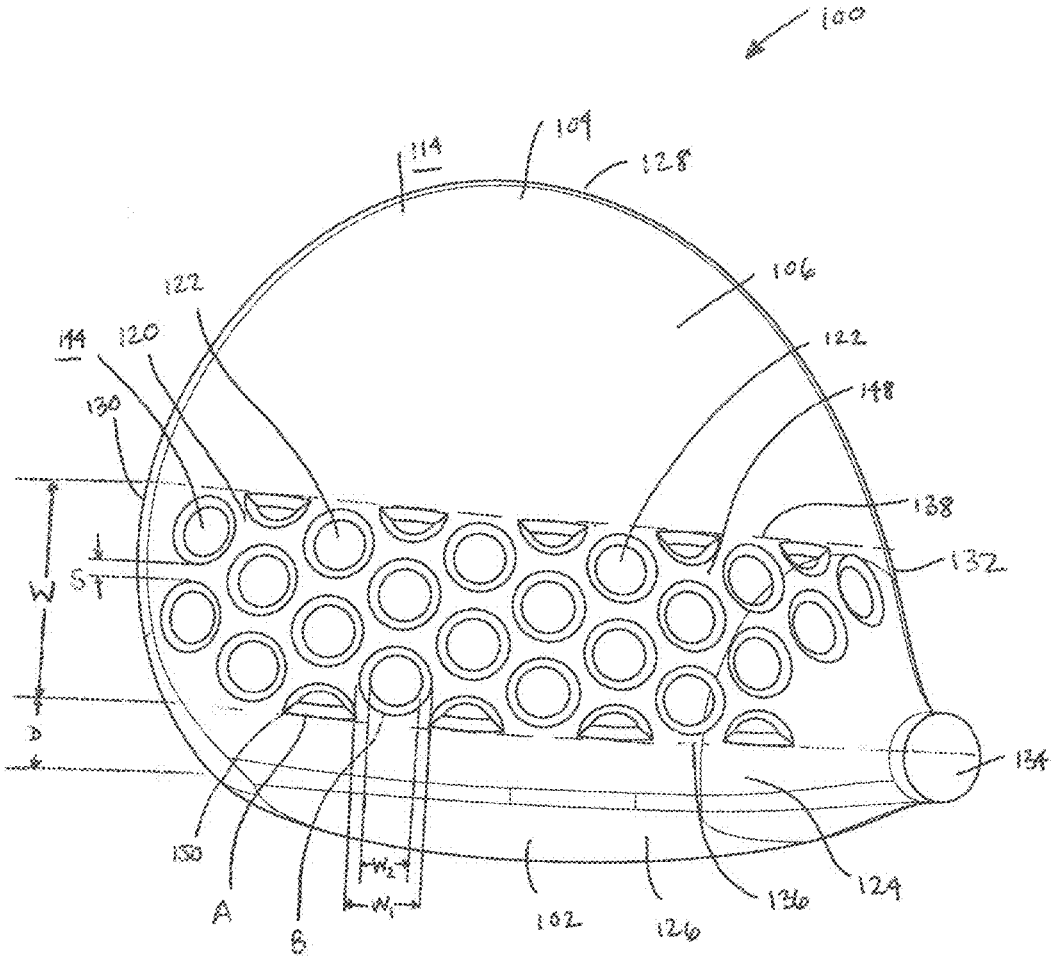
FIG. 9 of the accompanying drawings shows a top view of a club head in accordance with an alternative exemplary embodiment of the present invention.

In yet another embodiment shown in FIG. 9, a golf club head 100 in accordance with another exemplary embodiment of the present invention is shown. Golf club head 100 as described previously and shown in FIG. 9 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown to be provided on the crown portion 106. A setback 124 is provided in this embodiment, spacing the first portion 120 a distance D from the face 102 of the club head 100. As shown, the distance D is about 10 mm. The first portion 120 as shown has a depression coverage of about 50%. As discussed previously with regard to FIG. 2, the depressions 122 are provided from the toe 130 to the heel 132 of the club head 100 and the first portion 120 has a width W between the first and second boundaries 136, 138. As shown, width W is about 40 mm. It will be appreciated that alternating rows A, B of depressions 122 are provided on the first portion 120 in a front 126 to rear 128 orientation on the club head 100, such that the rows A, B are offset from one another by about a half of the depression 122, or half of the top width $w_1$, thereby providing partial depressions 150 at the start of row A adjacent the first boundary 136 and end of the row B adjacent the second boundary 138. The landing surface 148 provided between the spaced depressions 122 has a minimum landing surface spacing s of about 2.5 mm. In this embodiment, the depressions 122 are circles having a maximum top width, or diameter, $w_1$ of about 13 mm. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1 mm. In this embodiment, the circles provided on the first portion 120 are the same; however, it will be appreciated that the circles may vary in size, shape and/or depth.

Figure 10:
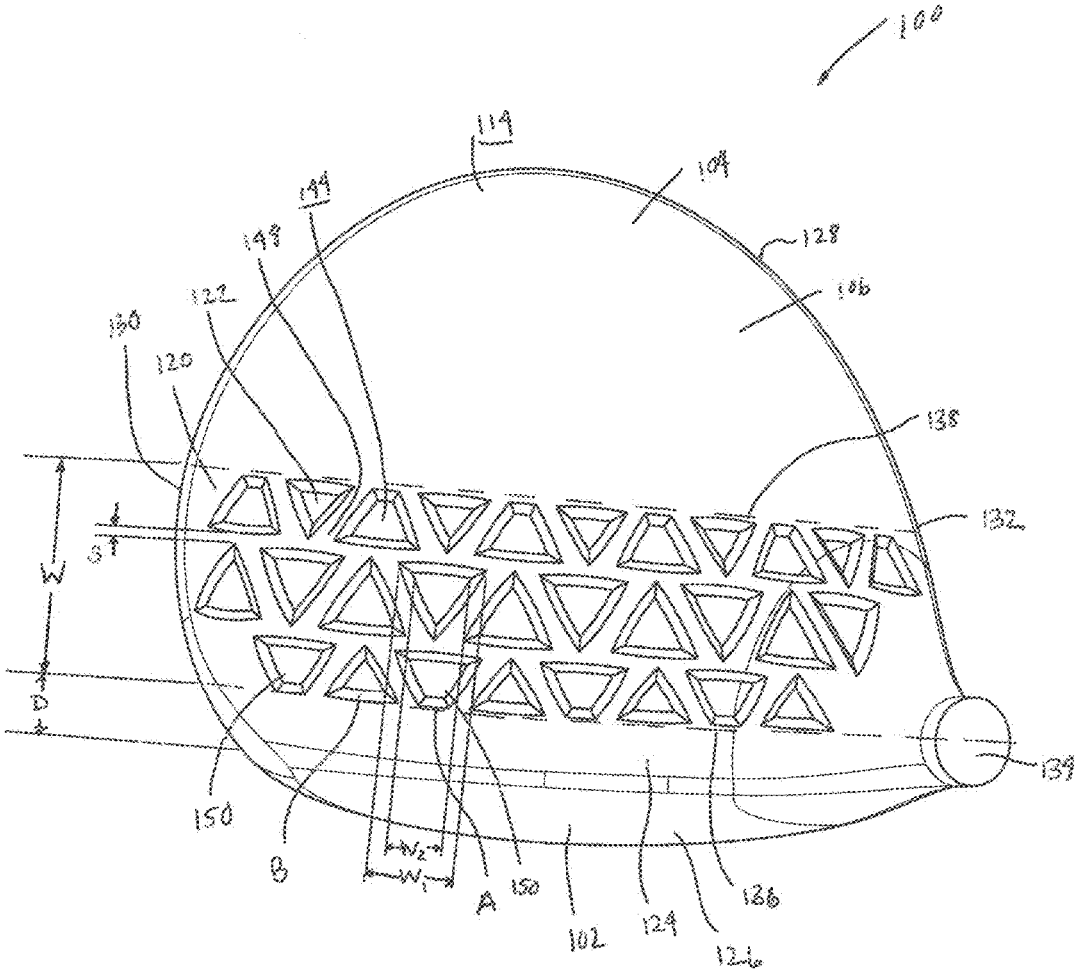
FIG. 10 of the accompanying drawings shows a top view of a club head in accordance with an alternative exemplary embodiment of the present invention.

Now referring to the embodiment of FIG. 10, a golf club head in accordance with another exemplary embodiment of the present invention is shown. Golf club head 100 as described previously and shown in FIG. 10 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown to be provided on the crown portion 106. A setback 124 is provided in this embodiment, spacing the first portion 120 a distance D from the face 102 of the club head 100. As shown, distance D is about 10 mm. The first portion 120 as shown has a depression coverage of about 50%. As discussed previously with regard to FIG. 2, the depressions 122 are provided from the toe 130 to the heel 132 of the club head 100 and the first portion 120 has a width W between first and second boundaries, 136, 138. As shown, the width W is about 40 mm. It will be appreciated that alternating rows A, B of depressions 122 are provided on the first portion 120 in a front 126 to rear 128 orientation on the club head 100, such that the rows A, B are offset from one another by about a half of the depression 122, or half of the top width $w_1$, thereby providing partial depressions 150 at the start and end of the rows A, B adjacent the first and second boundaries 136, 138. The landing surface 148 provided between the spaced depressions 122 has a minimum landing surface spacing s of about 2.5 mm. In this embodiment, the depressions 122 are triangles having a maximum top width $w_1$, or measurement, of about 13 mm. As shown, triangles in row A are oriented in an opposite direction from the triangles in row B. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1 mm. In this embodiment, the triangles provided on the first portion 120 are the same; however, it will be appreciated that the triangles may vary in size, shape and/or depth.

Figure 11:
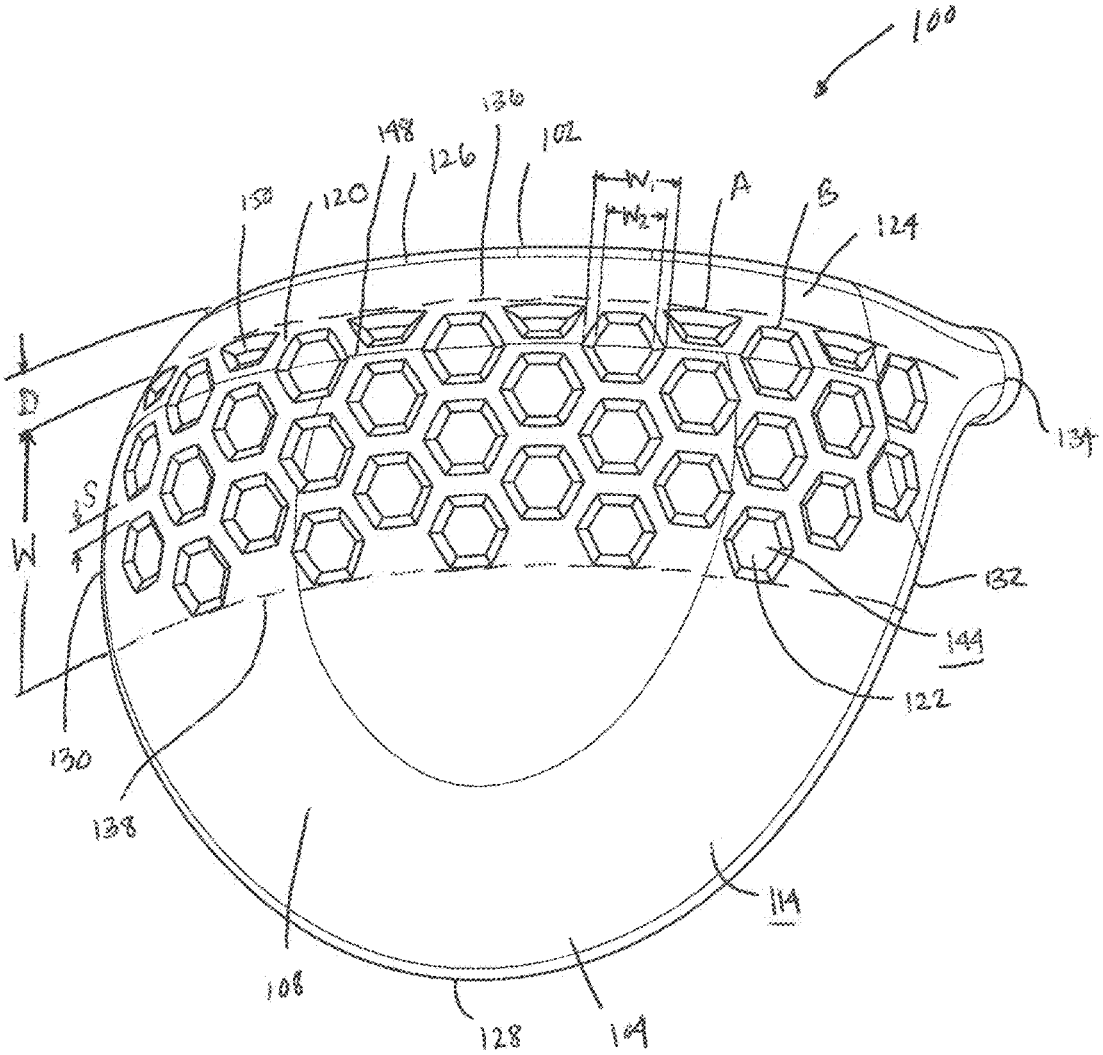
FIG. 11 of the accompanying drawings shows a bottom view of a club head in accordance with an alternative exemplary embodiment of the present invention.

As shown in FIG. 11, a golf club head 100 is provided in accordance with another exemplary embodiment of the present invention. Golf club head 100 as described previously and shown in FIG. 11 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown to be provided on the sole portion 108. A setback 124 is provided in this embodiment, spacing the first portion 120 a distance D from the face 102 of the club head 100. As shown, distance D is about 10 mm. The first portion 120 as shown has a depression coverage of about 50%. As discussed previously with regard to FIG. 2, the depressions 120 are provided from the toe 130 to the heel 132 of the club head 100 and the first portion 120 has a width W between first and second boundaries 136, 138. As shown, width W is about 40 mm. It will be appreciated that alternating rows A, B of depressions 122 are provided on the first portion 120 in a front 126 to rear 128 orientation on the club head 100, such that the rows A, B are offset from one another by about a half of the depression 122, or half of the top width $w_1$, thereby providing partial depressions 150 at the start of the row A adjacent the first boundary 136. The landing surface 148 provided between the spaced depressions 122 has a minimum landing surface spacing s of about 2.5 mm. In this embodiment, the depressions 122 are provided on the first portion 120 are hexagons having a maximum top width $w_1$ of about 13 mm. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1 mm. In this embodiment, the hexagons provided on the first portion 120 are the same; however, it will be appreciated that the hexagons may vary in size, shape and/or depth.

Figure 12:
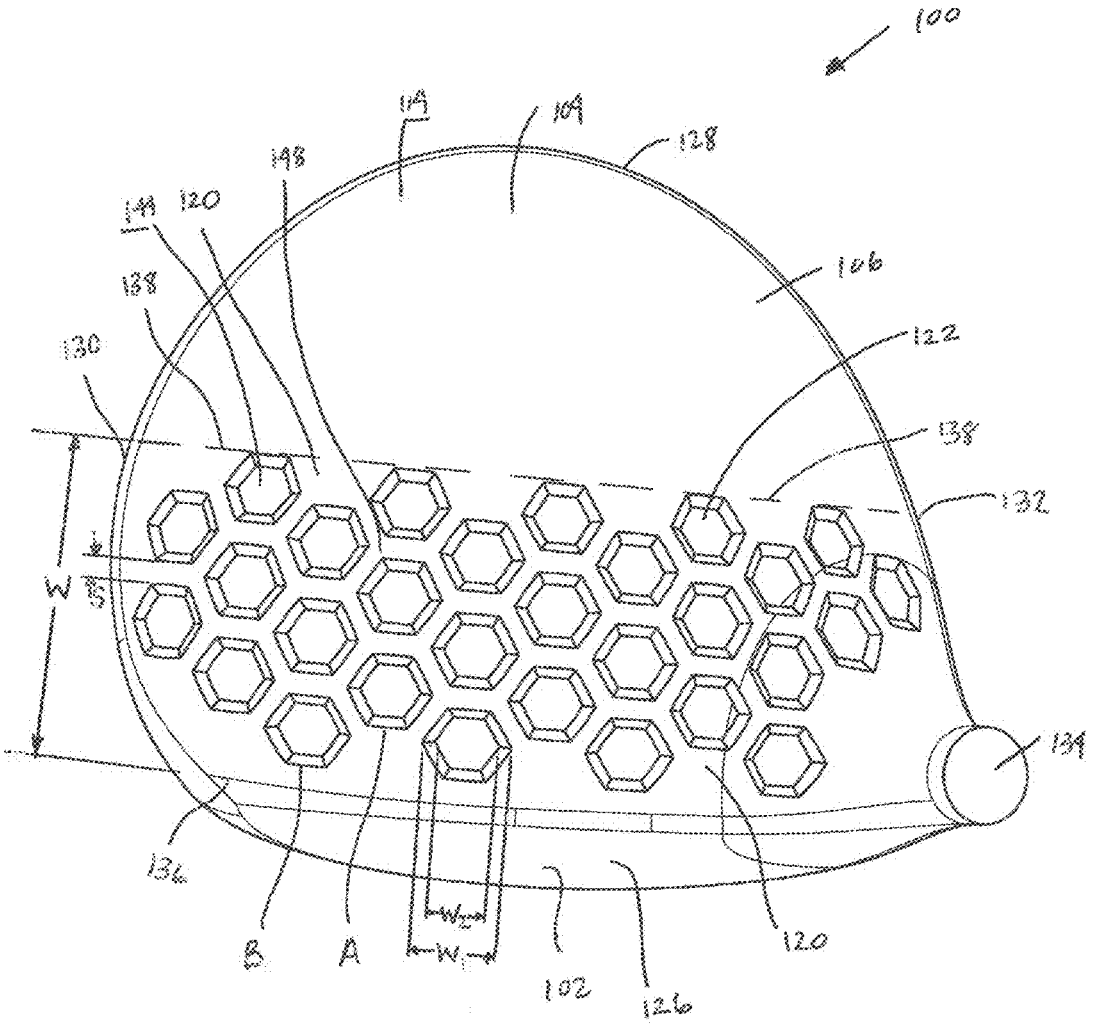
FIG. 12 of the accompanying drawings shows a top view of a club head in accordance with an alternative exemplary embodiment of the present invention.

A golf club head 100 shown in FIG. 12 illustrates yet another exemplary embodiment of the present invention is shown. Golf club head 100 as described previously and shown in FIG. 12 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown provided on the crown portion 106. No setback is provided in this embodiment, the depressions 122 being provided adjacent the face 102. The first portion 120 as shown has a depression coverage of about 50%. As discussed previously with regard to FIG. 2, the depressions 122 are provided from the toe 130 to the heel 132 of the club head 100 and the first portion 120 has a width W between first and second boundaries 136, 138. As shown, the width W is about 45 mm. It will be appreciated that alternating rows A, B of depressions 122 are provided on the first portion 120 in a front 126 to rear 128 orientation on the club head 100, such that the rows A, B are offset from one another by a about half of the depression 122, or half of the top width $w_1$. In this embodiment, no partial depressions have been provided in either row A, B or at the hosel 134, heel 132 or toe 130 of the club head 100. Instead, spaces on the exterior surface 114 are provided where the partial depressions would be located. The landing surface 148 provided between the spaced depressions 122 as shown has a minimum landing surface spacing s of about 2.5 mm. In this embodiment, the depressions 122 are hexagons having a maximum top width $w_1$ of about 13 mm. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1 mm. In this embodiment, the hexagons provided on the first portion 120 are the same; however, it will be appreciated that the hexagons may vary in size, shape and/or depth.

Figure 13:
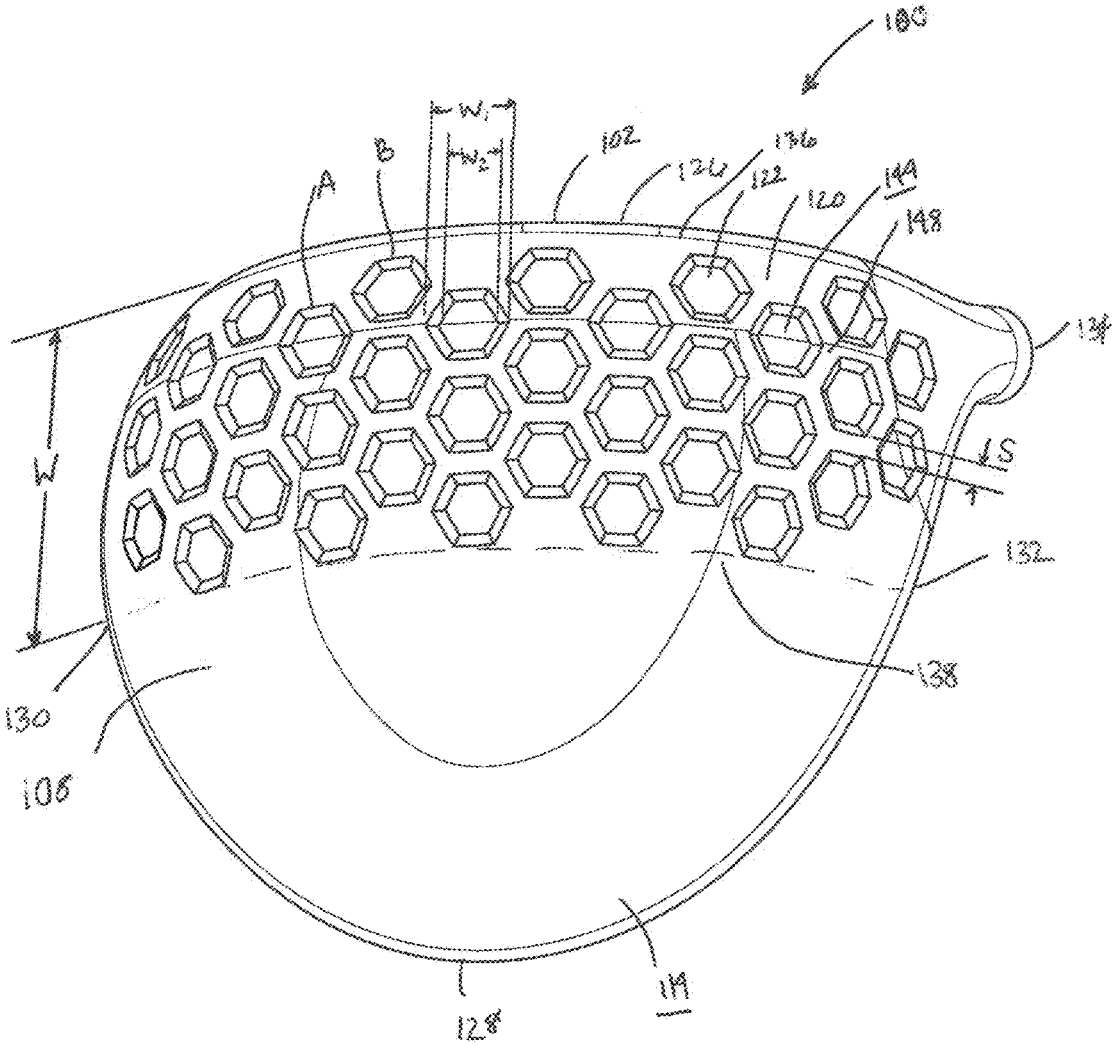
FIG. 13 of the accompanying drawings shows a bottom view of a club head in accordance with an alternative exemplary embodiment of the present invention.

FIG. 13 illustrates another exemplary embodiment of the present invention. Golf club head 100 as described previously and shown in FIG. 13 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown to be provided on the sole portion 108. No setback is provided in this embodiment, the depressions 122 being provided adjacent the face 102. The first portion 120 as shown has a depression coverage of about 50%. As discussed previously with regard to FIG. 2, the depressions 122 are provided from the toe 130 to the heel 132 of the club head 100 and the first portion 120 has a width W between first and second boundaries 136, 138. As shown, width W is about 45 mm. It will be appreciated that alternating rows A, B of depressions 122 are provided on the first portion 120 in a front 126 to rear 128 orientation on the club head 100, such that the rows A, B are offset from one another by about a half of the depression 122, or half of the top width $w_1$. In this embodiment, no partial depressions have been provided in either row A or B or at the hosel 134, heel 132 or toe 130. Instead, spaces on the exterior surface 114 are provided where the partial depressions would be located. The landing surface 148 provided between the spaced depressions 122 as shown has a minimum landing surface spacing s of about 2.5 mm. In this embodiment, the depressions 122 are hexagons having a maximum top width $w_1$ of about 13 mm. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1 mm. In this embodiment, the hexagons provided on the first portion 120 are the same; however, it will be appreciated that the hexagons may vary in size, shape and/or depth.

Figure 14:
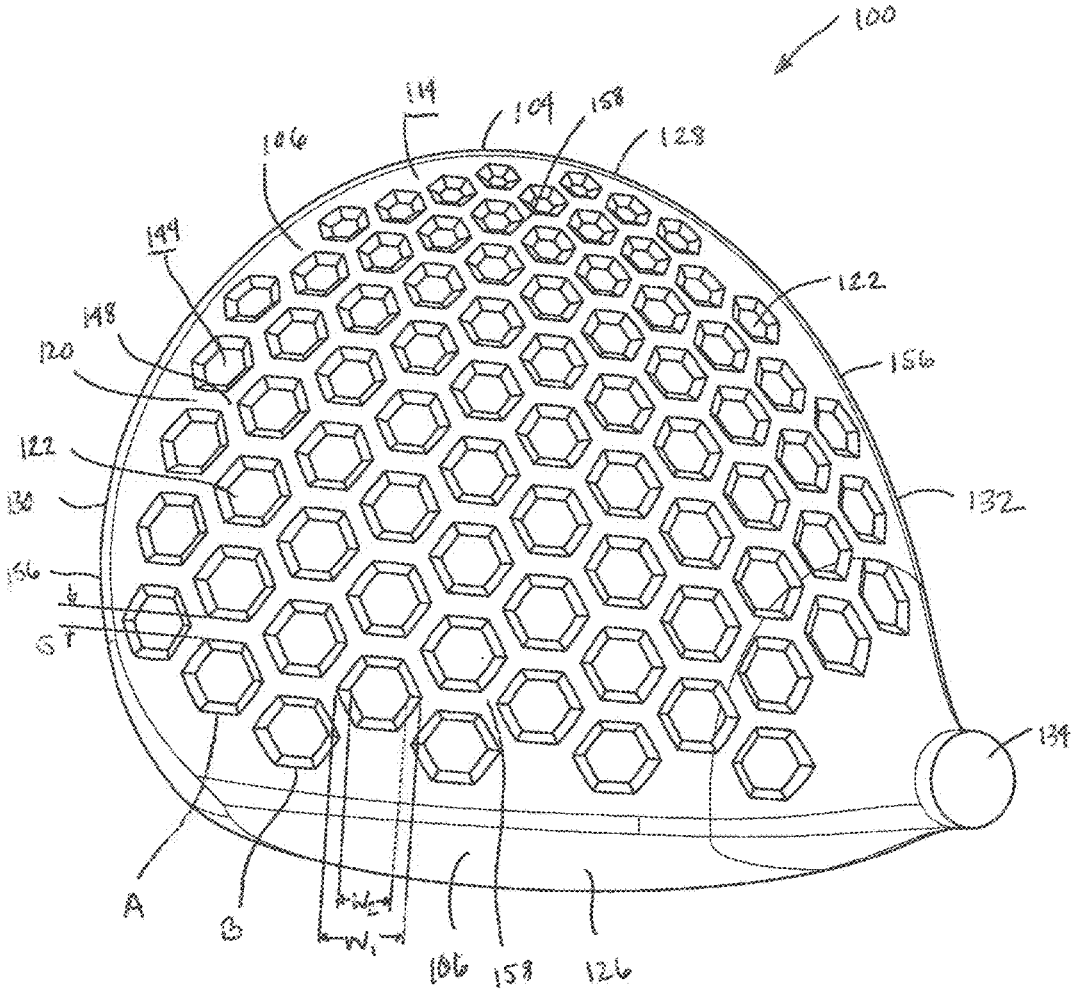
FIG. 14 of the accompanying drawings shows a top view of a club head in accordance with an alternative exemplary embodiment of the present invention.

A golf club head 100 in accordance with another exemplary embodiment of the present invention is shown in FIG. 14. Golf club head 100 as described previously and shown in FIG. 14 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown to be provided on the entire crown portion 106. No setback is provided in this embodiment, the depressions 122 being provided adjacent the face 102. The first portion 120 as shown has a depression coverage of about 50%. As discussed previously with regard to FIG. 2, the depressions 122 are provided from the toe 130 to the heel 132 of the club head 100. It will be appreciated that alternating rows A, B of depressions 122 are provided on the first portion 120 in a front 126 to rear 128 orientation on the club head 100, such that the rows A, B are offset from one another by about a half of the depression 122, or half of the top width $w_1$. In this embodiment, no partial depressions have been provided in either row A or B or at the hosel 134, heel 132 or 130. Instead, spaces on the exterior surface 114 are provided where the partial depressions would be located at the boundary 156 of the crown portion 106. The landing surface 148 provided between the spaced depressions 122 as shown has a minimum landing surface spacing s of about 2.5 mm. In this embodiment, the depressions 122 are hexagons having a maximum top width $w_1$ of about 12.5 mm. It will be appreciated that the depressions 122 have a base 144 and that the base 144 has a base width $w_2$ that is smaller than the top width $w_1$. Moreover, as shown, the base 144 of the depression 122 is flat and the depression 122 has a depth d of about 1 mm. The hexagons on the first portion 120 in this embodiment vary in size decreasing from the front 126 to the rear 128 of the club head 100, such that the smallest depression 122 has a top width $w_1$ of about 6.5 mm. Moreover, as shown in FIG. 14, the rows A, B, because of the variance in the size of the depressions 122 and the shape of the club head 100, have an increasing curvature as provided from the center 158 to the toe 130 and heel 132 of the club head 100. It will be appreciated that the shape and/or depth of the depressions 122 could also be varied.

Figure 15:
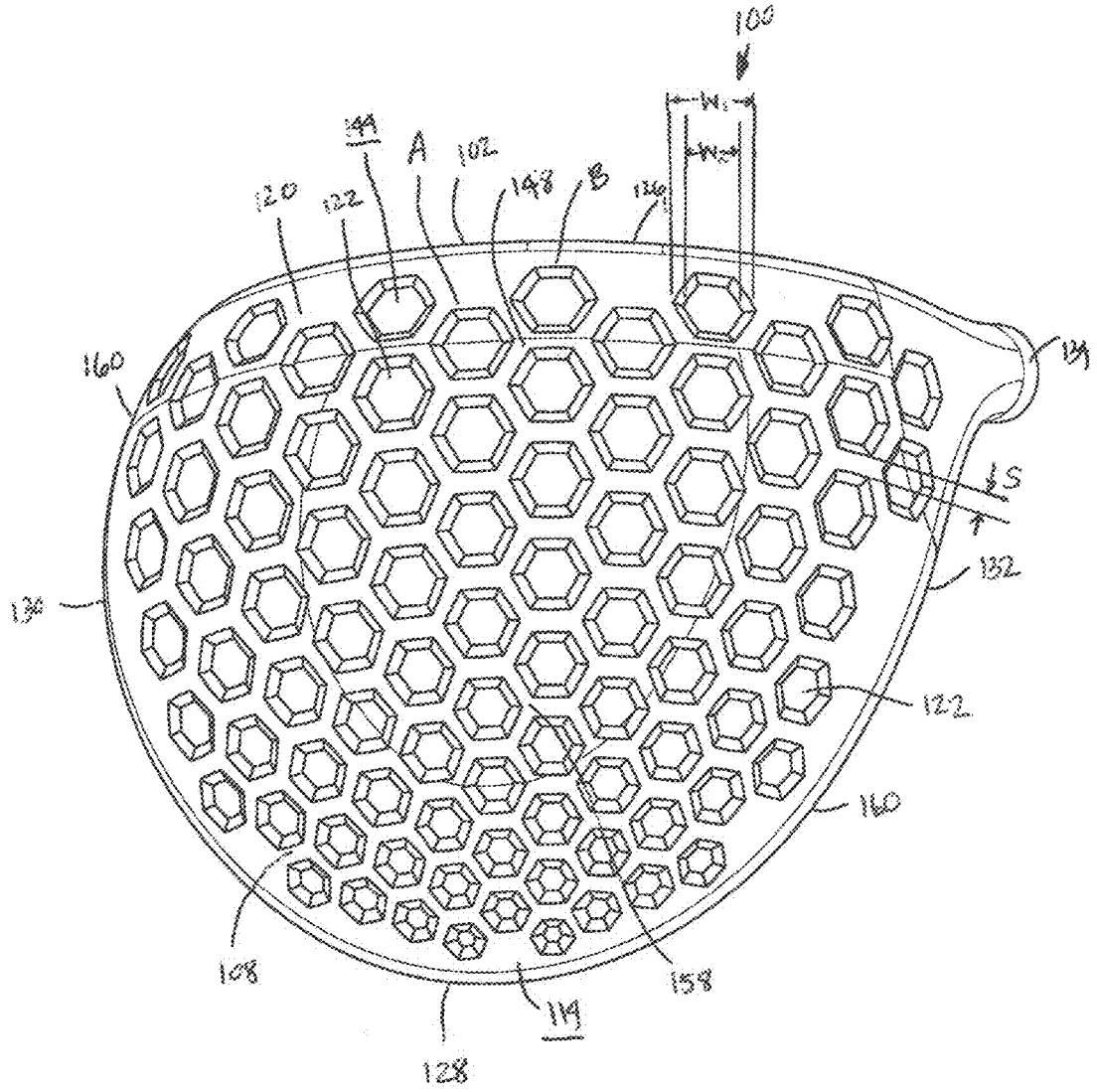
FIG. 15 of the accompanying drawings shows a bottom view of a club head in accordance with an alternative exemplary embodiment of the present invention.

FIG. 15 illustrates another exemplary embodiment of the present invention. Golf club head 100 as described previously and shown in FIG. 15 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown to be provided on the entire sole portion 108. No setback is provided in this embodiment, the depressions 122 being provided adjacent the boundary of the sole portion 108. The first portion 120 as shown has a depression coverage of about 50%. As discussed with regard to FIG. 2, the depressions 122 are provided from a toe 130 to a heel 132 the club head 100. It will be appreciated that alternating rows A, B of depressions 122 are provided on the first portion 120 in a front 126 to rear 128 orientation on the club head 100, such that the rows A, B are offset from one another by about a half of the depression 122, or half of the top width $w_1$. In this embodiment, no partial depressions have been provided in either row A or B or at the hosel 134, heel 132 or toe 130. Instead, spaces on the exterior surface 114 are provided where the partial depressions would be located at the boundary 160 of the sole portion 108. The landing surface 148 provided between the spaced depressions 122 has a minimum landing surface spacing s of about 2.5 mm. In this embodiment, the depressions 122 are hexagons having a 12.5 mm maximum top width $w_1$. It will be appreciated that the depressions 122 have a base 144 and that the base 144 has a base width $w_2$ that is smaller than the top width $w_1$. Moreover, the base 144 of the depression 122 is flat and the depression 122 has a depth d of about 1 mm. The hexagons on the first portion 120 in this embodiment vary in size decreasing from the front 126 to the rear 128 of the club head 100, such that the smallest depression 122 has a top width $w_1$ of about 6.5 mm. Moreover, as shown in FIG. 15, the rows A, B, because of the variance in size of the depressions 122 and the shape of the club head 100, have an increasing curvature as provided from the center 158 to the toe 130 and heel 132 of the club head 100. It will be appreciated that the shape and/or depth of the depressions 122 could also be varied.

Figure 16:
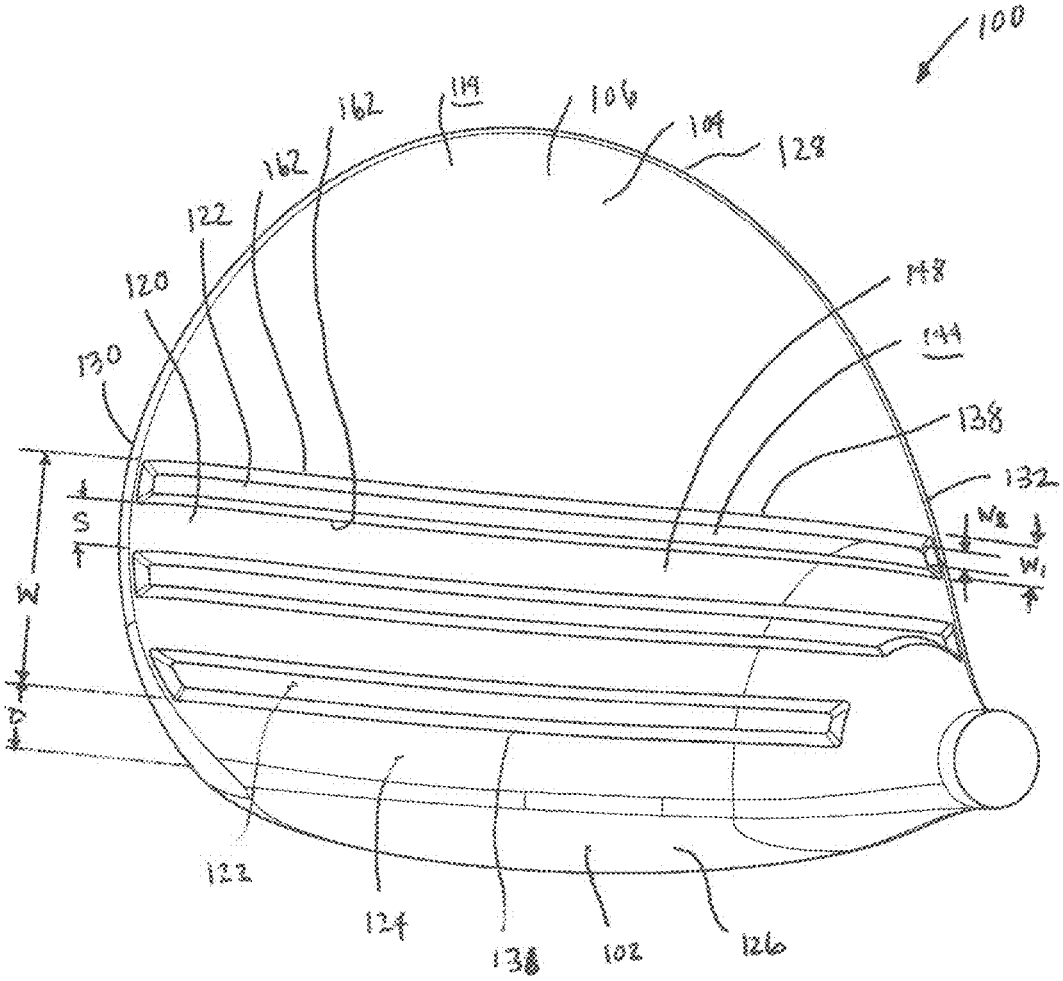
FIG. 16 of the accompanying drawings shows a top view of a club head in accordance with an alternative exemplary embodiment of the present invention.

Another exemplary embodiment of the present invention is shown in FIG. 16. Golf club head 100 as described previously and shown in FIG. 16 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown to be provided on the crown portion 106. A setback 124 is provided in this embodiment, spacing the first portion 120 a distance D from the face 102 of the club head 100. As shown, distance D is about 10 mm. The first portion 100 has a depression coverage of about 50%. As discussed previously with regard to FIG. 2, the depressions 122 are provided from the toe 130 to the heel 132 of the club head 100 and the first portion 120 has a width W between first and second boundaries 136, 138. As shown, the width W is about 35 mm. The landing surface 148 provided between the spaced depressions 122 has a minimum landing surface spacing s of about 2 mm. In this embodiment, the depressions 122 provided on the first portion 120 are rectangles having a maximum top width $w_1$. The rectangles have a base 144, the base 144 has a base width $w_2$ that is smaller than the top width $w_1$. Moreover, as shown, the base 144 of the depression 122 is flat and the depression 122 has a depth d of about 1 mm. The rectangles are provided in a toe 130 to heel 132 orientation on the club head 100. It will be appreciated that in this embodiment the rectangles are the same top width $w_1$; however, it will be appreciated that the rectangles may vary in size, shape and/or depth. For example, the rectangles may have at least two non-parallel sides 162.

Figure 17:
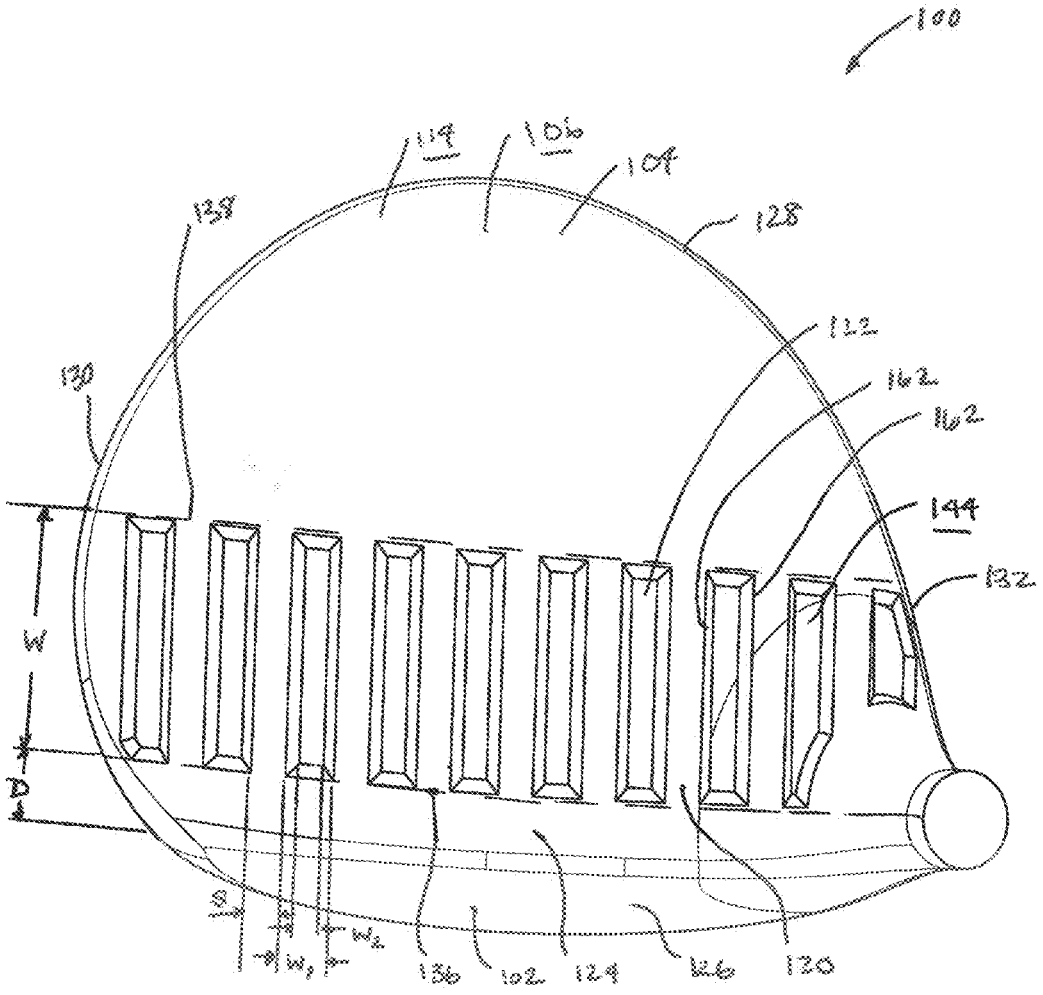
FIG. 17 of the accompanying drawings shows a top view of a club head in accordance with an alternative exemplary embodiment of the present invention.

Another exemplary embodiment of the present invention is shown in FIG. 17. Golf club head 100 as described previously and shown in FIG. 17 has an exterior surface 114 provided opposite the hollow golf club interior. According to the invention, at least a first portion 120 of the exterior surface 114 is provided with a plurality of indentations or depressions 122. The first portion 120 of the exterior surface 114 is shown provided on the crown portion 106. A setback 124 is provided in this embodiment, spacing the first portion 120 a distance D from the face 102 of the club head 100. As shown, distance D is about 10 mm. The first portion 120 as shown has a depression coverage of about 50%. As discussed previously with regard to FIG. 2, the depressions 122 are provided from the toe 130 to the heel 132 of the club head 100 and the first portion 120 has a width W between first and second boundaries 136, 138. As shown, the width W is about 35 mm. In this embodiment, the depressions 122 provided on the first portion 120 are rectangles having a maximum top width $w_1$. The rectangles have a base 144, the base 144 has a base width $w_2$ that is smaller than the top width $w_1$. Moreover, as shown, the base 144 of the depression 122 is flat and the depression 122 has a depth d of about 1 mm. The rectangles are provided in a front 126 to rear 128 orientation on the club head 100. The landing surface 148 provided between the spaced depressions 122 as shown has a minimum landing surface spacing s of about 2 mm. It will be appreciated that in this embodiment, the rectangles are the same top width $w_1$; however, it will be appreciated that the rectangles may vary in size, shape and/or depth. For example, they may decrease in size from the front of the first portion to the rear of the first portion, such that the sides 162 of the rectangle are not parallel with one another.

Figure 18:
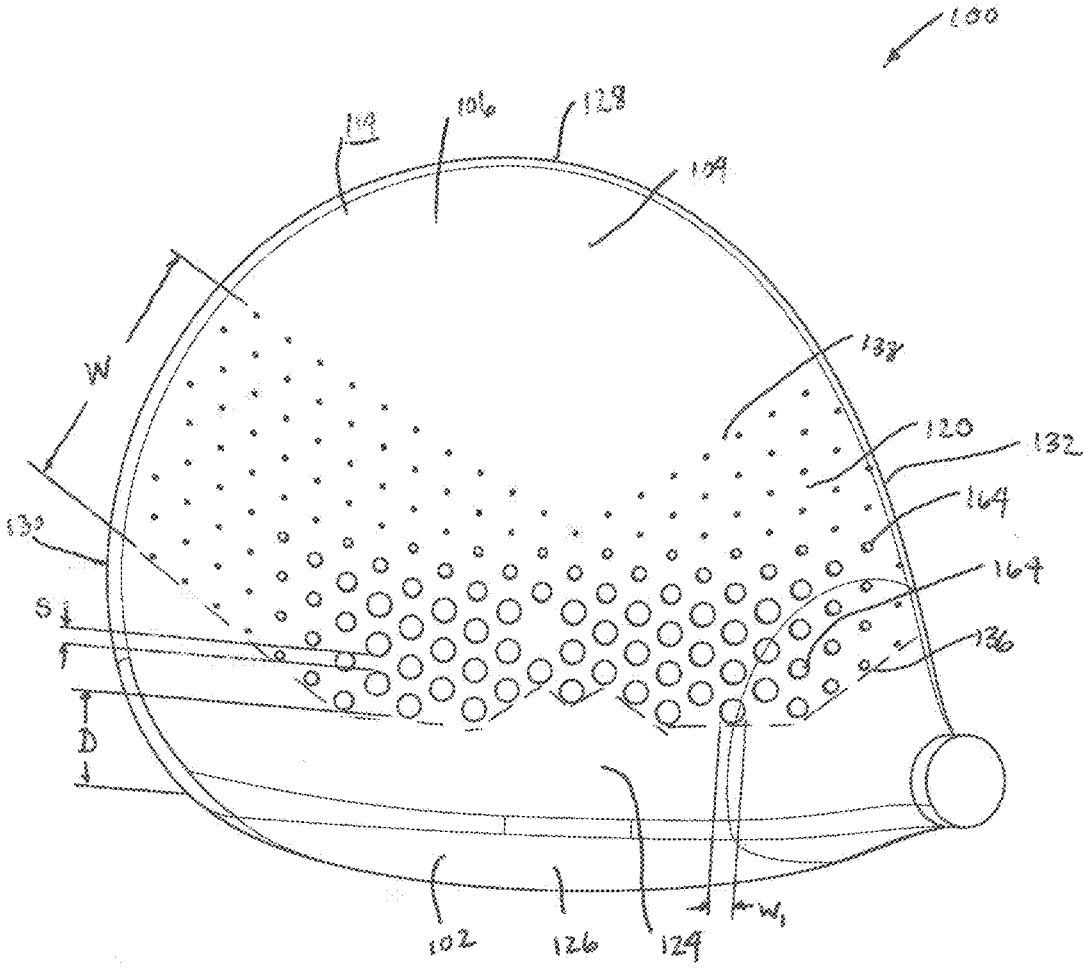
FIG. 18 of the accompanying drawings shows a top view of a club head in accordance with an alternative exemplary embodiment of the present invention.
Figure 19:
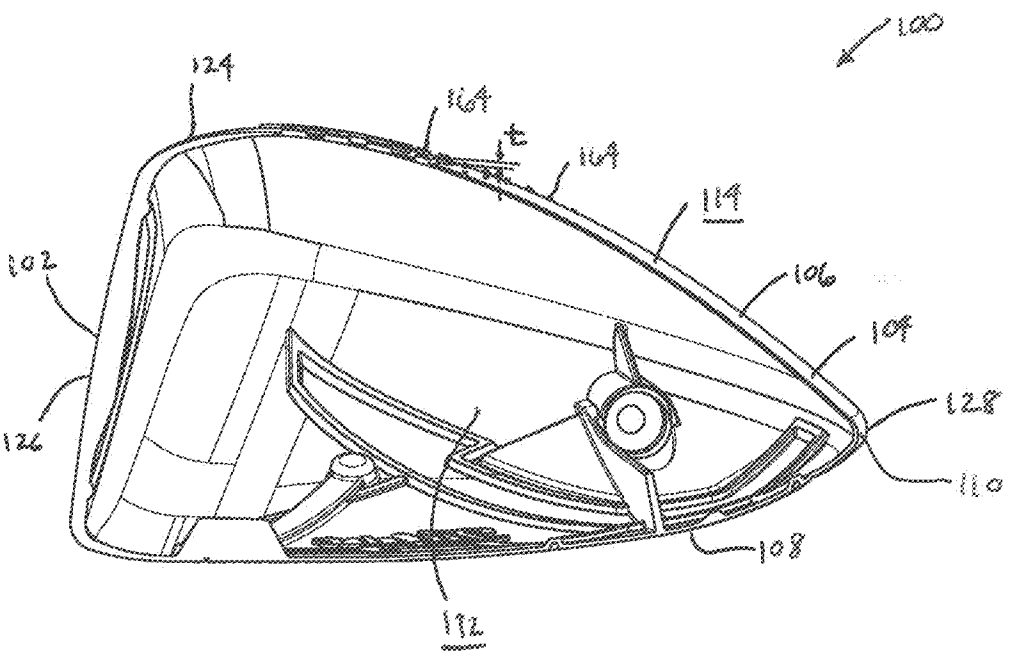
FIG. 19 of the accompany drawings shows a cross-sectional view of the exemplary golf club head of FIG. 18.

Yet another exemplary embodiment of a golf club head is shown in FIGS. 18 and 19. Golf club head 100 as described previously and shown in FIGS. 18 and 19 has an exterior surface 114 provided opposite the hollow golf club interior. According to the invention, at least a first portion 120 of the exterior surface 114 is provided with a plurality of protrusions 164. The first portion 120 of the exterior surface 114 is shown to be provided on the crown portion 106, although it will be appreciated that the first portion 120 may be provided on the sole portion 108 or other portion of the club head 100. A setback 124 is provided in this embodiment, spacing the first portion a minimum distance D from the striking face of the club head. As shown, the setback 124 has a varied distance D. As shown, minimum distance D is about 15 mm. The first portion 120 preferably has a protrusion coverage of about 25-75%, and as shown about 50%. In this embodiment, the protrusions 164 are circles having a maximum top width, or diameter, $w_1$. As discussed with regard to FIG. 2, the protrusions 164 are provided from a toe 130 to a heel 132 of the club head 100 and the first portion 120 has a maximum width W between first and second boundaries 136, 138. As shown, width W is about 45 mm. The landing surface 148 provided between the spaced protrusions 164 as shown has a minimum landing surface spacing s of about 2 mm. It will be appreciated that in this embodiment the circles have different top widths $w_1$, or diameters, and decrease in size from the front 126 to the rear 128 of the club head 100 with the first portion 120. However, it will be appreciated that the circles may be the same size. Moreover, the thickness t of the protrusions 164, as shown in FIG. 19, may vary and decreases from the front 126 to the rear 128 of the club head 100. It will be appreciated that the thickness t of the protrusions 164 may be the same.

It will be appreciated that the drawings illustrate a driver according to the present invention having a volume of about 375cc to about 475 cc, and more preferably a volume of about 420cc to about 475cc. It will be appreciated that the depressions 122 or protrusions 164 according to the invention may be incorporated on any exterior surface 114 of any hollow type club head.

It will be appreciated that the majority of the embodiments of the present invention show indentations or depressions 122 provided on the first portion 120. However, it will be appreciated that the depressions 122 in any embodiment may be provided instead as protrusions 164 and vice versa.

Different embodiments of the present invention are shown in FIGS. 2-19 having different shaped depressions 122 or protrusions 164. In fact, it will be appreciated that in alternative embodiments of the present invention the depressions 122 or protrusions 164 may have any suitable shape, including circular, oval, rectangular, or other polygon. Moreover, the depressions 122 or protrusions 164 may be regular or irregular shapes.

It will be appreciated that the golf club head 100 may be made of any type of material or combinations thereof as is known in the art whether metal or non-metal materials.

The golf club head 100 may be made by any known method, including casting. For example the depressions 122 or protrusions 164 may be cast or otherwise formed in the club head 100. In another embodiment, the depressions 122 or protrusions 164 may be formed by placement of an adhesive sticker over the exterior surface 114 of the club head 100. It will be appreciated that the sticker would have a varied thickness to provide the depressions 122 or protrusions 164 on the club head 100. Moreover, it will be appreciated that the sticker may cover solely the first portion 120 as described above or a larger portion of the club head 100, including the entire club head 100.

Other than in the operating example, or unless otherwise expressly specified, all of the numerical ranges, amounts, values and percentages such as those for measurements, amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a body having a face, a sole portion, a crown portion and a skirt portion joining the face, sole portion and crown portion;

a hollow golf club interior within the body;

an exterior surface provided opposite the hollow golf club interior;

a plurality of depressions provided on a first portion of the exterior surface of the body;

wherein the plurality of depressions have a depth of about 0.5 mm to about 2 mm, have a width of about 6 mm to about 20 mm and have a minimum landing surface spacing of about 0.5 mm to about 7 mm between depressions on the exterior surface, and wherein the first portion is provided on at least one of a sole portion or crown portion of the body and further comprises a setback from the face portion of the body, the setback being free of depressions, and wherein the setback has a width of about 6 mm to about 14 mm.

2. The golf club head of claim 1, wherein the first portion is provided on at least half of the crown portion.

3. The golf club head of claim 1, wherein the first portion is provided on at least half the sole portion.

4. The golf club head of claim 1, wherein the first portion has a depression coverage of about 25% to about 75%.

5. The golf club head of claim 1, wherein the body has a toe portion on one side of the body adjacent the face and a heel portion on the opposite side of the body adjacent the face and hosel, and the first portion extends from the toe of the body to the heel of the body.

6. The golf club head of claim 1, wherein the depressions have a polygonal shape.

7. The golf club head of claim 1, wherein the body has a front adjacent the face of the body and a rear opposite the face of the body and the depressions decrease in size from the front toward the rear of the body.

8. A golf club head comprising:

a body having a face, a sole portion, a crown portion and a skirt portion joining the face portion, sole portion and crown portion;

a hollow golf club interior within the body; and an exterior surface provided opposite the hollow golf club interior, wherein a first aerodynamic drag force reduction of the club head is achieved by shaping the body of the club head, and a second aerodynamic drag force reduction of the club head is achieved by providing a plurality of depressions on a first portion of the exterior surface of the body, and wherein the additional reduction in aerodynamic drag force achieved by the second aerodynamic drag force reduction is about 5 to about 25 percent, and further comprising a setback from the face portion of the body, the setback being free of depressions and wherein the setback has a width of about 6 mm to about 14 mm.

9. The golf club head of claim 8, wherein the second reduction in aerodynamic drag force is about 10 to about 18 percent.

10. The golf club head of claim 8, where the first portion is provided on at least one of a sole portion or crown portion of the body.

11. The golf club head of claim 10, wherein the first portion is provided on at least half of the crown portion.

12. The golf club head of claim 10, wherein the first portion is provided on at least half the sole portion.

13. The golf club head of claim 8, wherein the first portion has a depression coverage of about 25% to about 75% of the club head portion.

14. The golf club head of claim 8, wherein the body has a toe portion on one side of the body adjacent the face and a heel portion on the opposite side of the body adjacent the face and hosel and the first portion extends from the toe of the body to the heel of the body.

15. The golf club head of claim 8, wherein the each of the plurality of depressions has a depth of about 0.5 mm to about 2 mm and have a width of about 6 mm to about 20 mm.

16. The golf club head of claim 8, wherein the depressions have a landing surface spacing of about 1 mm to about 4 mm between depressions on the exterior surface.

17. The golf club head of claim 8, wherein the depressions have a polygonal shape.

18. The golf club head of claim 8, wherein the body has a front adjacent the face of the body and a rear opposite the face of the body and the depressions decrease in size from the front toward the rear of the body.

* * * * *